US011138893B2

(12) United States Patent
Cao et al.

(10) Patent No.: US 11,138,893 B2
(45) Date of Patent: Oct. 5, 2021

(54) FLIGHT CONFLICT RESOLUTION METHOD AND APPARATUS BASED ON ULTIMATUM GAME THEORY

(71) Applicant: BEIHANG UNIVERSITY, Beijing (CN)

(72) Inventors: Xianbin Cao, Beijing (CN); Wenbo Du, Beijing (CN); Yumeng Li, Beijing (CN); Biyue Li, Beijing (CN); Lei Zheng, Beijing (CN)

(73) Assignee: BEIHANG UNIVERSITY, Beijing (CN)

( * ) Notice: Subject to any disclaimer, the term of this patent is extended or adjusted under 35 U.S.C. 154(b) by 310 days.

(21) Appl. No.: 16/270,556

(22) Filed: Feb. 7, 2019

(65) Prior Publication Data

US 2020/0126436 A1 Apr. 23, 2020

(30) Foreign Application Priority Data

Oct. 18, 2018 (CN) ..... 201811214748.6

(51) Int. Cl.
*G08G 5/04* (2006.01)
*G08G 5/00* (2006.01)

(52) U.S. Cl.
CPC ..... *G08G 5/045* (2013.01); *G08G 5/0039* (2013.01); *G08G 5/0095* (2013.01)

(58) Field of Classification Search
CPC . G08G 5/045; G08G 9/00; G08G 9/02; G01P 13/025; G05D 1/1064
See application file for complete search history.

(56) References Cited

U.S. PATENT DOCUMENTS 6,546,338 B2 * 4/2003 Sainthuile ..... G08G 5/045 701/301
7,702,427 B1 4/2010 Sridhar et al.
(Continued)

FOREIGN PATENT DOCUMENTS

CN 102184646 A 9/2011
CN 104200707 A 12/2014
CN 107516439 A 12/2017

OTHER PUBLICATIONS

Paielli, Russell A., "Modeling Maneuver Dynamics in Air Traffic Conflict Resolution", 2003, Journal of Guidance, Control, and Dynamics, vol. 26, No. 3, pp. 2-3 (Year: 2003).*
(Continued)

*Primary Examiner* — Aniss Chad
*Assistant Examiner* — Madison R Hughes
(74) *Attorney, Agent, or Firm* — J.C. Patents

(57) ABSTRACT

Provided are flight conflict resolution method and apparatus based on ultimatum game theory. The method includes: obtaining a first priority of a first aircraft and a second priority of a second aircraft when it is determined that a minimum distance between the first aircraft and the second aircraft within a preset time period is less than a preset distance; determining a first angle and a second angle of the first aircraft and a fourth angle and a fifth angle of the second aircraft according to the first priority, the second priority, and a preset limiting deflection angle; determining a third angle of the first aircraft and a sixth angle of the second aircraft; determining a first deflection angle of the first aircraft and a second deflection angle of the second aircraft according to the first and second priorities, the first, second, third, fourth, fifth and sixth angles.

7 Claims, 5 Drawing Sheets

(56) References Cited

U.S. PATENT DOCUMENTS

| | | | | |
|---|---|---|---|---|
| 9,737,988 | B2 | 8/2017 | Pham et al. | |
| 2004/0068351 | A1 | 4/2004 | Solomon | |
| 2019/0051193 | A1* | 2/2019 | Gutierrez | G08G 5/0069 |

OTHER PUBLICATIONS

Yoo, Jeff et al., "Provably Safe Conflict Resolution With Bounded Turn Rate for Air Traffic Control", Nov. 2013, IEEE Transactions on Control Systems Technology, vol. 21, No. 6, pp. 1-4 (Year: 2013).*

Cuoco, Albert A., "The Roles of Representation in School Mathematics: 2001 Yearbook", Jun. 1, 2001, National Council of Teachers of Mathematics, pp. 119 and 123 (Year: 2001).*

Xiaohui, Ji, "A Collision Avoidance Method based on Satisficing Game Theory", 2012, 4th International Conference on Intelligent Human-Machine Systems and Cybernetics, pp. 1-3 (Year: 2012).*

Guan, Xiangmin et al., "Research on the aircraft conflict resolution based on satisfying game theory" Journal of Acta Aeronautica et Astronautica Sinica; vol. 35, No. X; (Jan. 25, 2017); pp. 721475-1-721475-9.

The Chinese First Examination Report of corresponding Chinese application No. 201811214748.6, dated Jan. 6, 2020.

Notice of Allowance of the priority China application No. 201811214748.6.

* cited by examiner

FLIGHT CONFLICT RESOLUTION METHOD AND APPARATUS BASED ON ULTIMATUM GAME THEORY

CROSS-REFERENCE TO RELATED APPLICATIONS

This application claims priority to Chinese Patent Application No. 201811214748.6, filed on Oct. 18, 2018, entitled "Flight Control Method and Apparatus Based on Ultimatum Game Theory", which is incorporated herein by reference in its entirety.

TECHNICAL FIELD

Embodiments of the present disclosure relate to the field of aircraft technologies, and in particular, to flight conflict resolution method and apparatus based on ultimatum game theory.

BACKGROUND

With a continuous development of our country's economy, a number of aircrafts (such as civilian passenger aircrafts and military fighters) has also increased rapidly accordingly.

At present, different aircrafts have different routes, speeds and deflection angles during their flights in the air. For example, when an aircraft is flying on its fixed route at a fixed speed, there may be an intersection between the route of at least one other aircraft in the airspace and the route of the aircraft. If a safety distance between the aircrafts is less than a preset distance at the intersection, a flight conflict occurs between the aircrafts, resulting in reduced flight safety of the aircrafts.

SUMMARY

Embodiments of the present disclosure provide flight conflict resolution method and apparatus based on ultimatum game theory to overcome the problem of reduced flight safety of an aircraft.

In a first aspect, an embodiment of the present disclosure provides a flight conflict resolution method based on ultimatum game theory, including:

obtaining a first priority of a first aircraft and a second priority of a second aircraft when it is determined that a minimum distance between the first aircraft and the second aircraft within a preset time period is less than a preset distance;

determining a first angle and a second angle of the first aircraft and a fourth angle and a fifth angle of the second aircraft according to the first priority, the second priority and a preset limiting deflection angle, where the first angle is a maximum acceptable deflection angle of the first aircraft, the second angle is an angle by which the first aircraft is desired to be deflected, the fourth angle is a maximum acceptable deflection angle of the second aircraft, and the fifth angle is an angle by which the second aircraft is desired to be deflected;

determining a third angle of the first aircraft and a sixth angle of the second aircraft, where the third angle is a deflection angle of the first aircraft causing the minimum distance between the first aircraft and the second aircraft within the preset time period greater than or equal to the preset distance when the second aircraft is not deflected, and the sixth angle is a deflection angle of the second aircraft causing the minimum distance between the first aircraft and the second aircraft within the preset time period greater than or equal to the preset distance when the first aircraft is not deflected;

determining a first deflection angle of the first aircraft and a second deflection angle of the second aircraft according to the first priority, the second priority, the first angle, the second angle, the third angle, the fourth angle, the fifth angle and the sixth angle.

In a possible implementation, the determining the first deflection angle of the first aircraft and the second deflection angle of the second aircraft according to the first priority, the second priority, the first angle, the second angle, the third angle, the fourth angle, the fifth angle and the sixth angle includes:

determining a first negotiation angle of the first aircraft among the first angle, the second angle and the third angle according to the first priority and the second priority;

determining a second negotiation angle of the second aircraft among the fourth angle, the fifth angle and the sixth angle according to the first priority and the second priority;

determining the first deflection angle and the second deflection angle according to the first priority, the second priority, the first negotiation angle, the second negotiation angle, the first angle and the fourth angle.

In another possible implementation, the second priority is greater than the first priority;

the determining the first negotiation angle of the first aircraft among the first angle, the second angle and the third angle according to the first priority and the second priority includes:

determining the first negotiation angle according to the following formula 1:

$$\beta_{P_{a_j}} = \begin{cases} \beta_{P_{a_j}}^{max}, \text{ when } \beta_{min}^{low} > \beta_{P_{a_j}}^{max} \text{ and } \beta_{Q_{a_i}}^{max} < \beta_{min}^{low} \\ \beta_{min}^{low}, \text{ when } \beta_{Q_{a_i}}^{max} > \beta_{min}^{low} > \beta_{P_{a_j}}^{max} \\ \beta_{min}^{low}, \text{ when } \beta_{min}^{low} < \beta_{P_{a_j}}^{max} \end{cases} \quad \text{(formula 1)}$$

where $$\beta_{P_{a_j}}$$

is the first negotiation angle, $a_j$ is the second aircraft, $$\beta_{P_{a_j}}^{max}$$

is the second angle, $\beta_{min}^{low}$ is the third angle, and $$\beta_{Q_{a_i}}^{max}$$

is the first angle;

the determining the second negotiation angle of the second aircraft among the fourth angle, the fifth angle and the sixth angle according to the first priority and the second priority includes:

determining the second negotiation angle according to the following formula 2:

$$\beta_{P_{a_i}} = \min\{\beta_{min}^{high}, \beta_{P_{a_i}}^{max}\} \quad \text{(formula 2)}$$

where $$\beta_{P_{a_i}}$$

is the second negotiation angle, $a_i$ is the first aircraft, $\beta_{min}^{high}$ is the sixth angle, and $$\beta_{P_{a_i}}^{max}$$

is the fifth angle.

In another possible implementation, the determining the first deflection angle and the second deflection angle according to the first priority, the second priority, the first negotiation angle, the second negotiation angle, the first angle and the fourth angle includes:

determining whether the first negotiation angle is less than the first angle;

if yes, determining that the first deflection angle is the first negotiation angle, and the second deflection angle is zero;

if no, determining whether the minimum distance between the first aircraft and the second aircraft within the preset time period is less than the preset distance when the first aircraft is deflected by the first angle, if no, determining that the first deflection angle is the first angle and the second deflection angle is zero, and if yes, determining the first deflection angle and the second deflection angle according to the second negotiation angle and the fourth angle.

In another possible implementation, the determining the first deflection angle and the second deflection angle according to the second negotiation angle and the fourth angle includes:

determining whether the second negotiation angle is less than the fourth angle;

if yes, determining that the first deflection angle is the first angle, and the second deflection angle is the second negotiation angle;

If no, determining that the second deflection angle is the fourth angle, and determining the first deflection angle according to the fourth angle and flight information of the first aircraft and the second aircraft.

In another possible implementation, the determining the first angle and the second angle of the first aircraft and the fourth angle and the fifth angle of the second aircraft according to the first priority, the second priority, and the preset limiting deflection angle includes:

determining the first angle according to the following formula 3:

$$\beta_{Q_{a_i}}^{max} = \pm\left|\beta \times \frac{n_i}{M}\right| \quad \text{(formula 3)}$$

where $$\beta_{Q_{a_i}}^{max}$$

is the first angle, β is the preset limiting deflection angle, M is a total number of aircrafts in an airspace, and $n_i$ is a priority ordinal number of the first aircraft;

determining the second angle according to the following formula 4:

$$\beta_{P_{a_j}}^{max} = \pm\left|\beta \times \frac{M - n_j}{M}\right| \quad \text{(formula 4)}$$

where $$\beta_{P_{a_j}}^{max}$$

is the second angle, and $n_j$ is a priority ordinal number of the second aircraft;

determining the fourth angle according to the following formula 5:

$$\beta_{Q_{a_j}}^{max} = \pm\left|\beta \times \frac{n_j}{M}\right| \quad \text{(formula 5)}$$

where $$\beta_{Q_{a_j}}^{max}$$

is the fourth angle;

determining the fifth angle according to the following formula 6:

$$\beta_{P_{a_i}}^{max} = \pm\left|\beta \times \frac{M - n_i}{M}\right| \quad \text{(formula 6)}$$

where $$\beta_{P_{a_i}}^{max}$$

is the fifth angle.

In another possible implementation, the determining the third angle of the first aircraft and the sixth angle of the second aircraft includes:

determining the third angle according to the following formula 7:

$$\beta_{min}^{low} = \left[\cos^{-1}\left(\frac{s_{ij}^2 + s_{ii}^2 - (2R_a)^2}{2s_{ij}s_{ii}}\right) - \cos^{-1}\left(\frac{s_{ij}^2 + s_{ii}^2 - (2d_{min})^2}{2s_{ij}s_{ii}}\right)\right]_{min} \quad \text{(formula 7)}$$

where $\beta_{min}^{low}$ is the third angle, $d_{min}$ is a minimum distance between $a_i$ and $a_j$ in a future preset time period, $s_{ij}$ is a distance between a position of $a_i$ at a current moment and a position of $a_j$ when the minimum distance occurs, and $s_{ii}$ is a distance between the position of $a_i$ at the current moment and a position of $a_i$ when the minimum distance occurs, $R_a$ is the preset distance;

determining the sixth angle according to the following formula 8:

$$\beta_{min}^{high} = \left[\cos^{-1}\left(\frac{s_{ji}^2 + s_{jj}^2 - (2R_a)^2}{2s_{ji}s_{jj}}\right) - \cos^{-1}\left(\frac{s_{ji}^2 + s_{jj}^2 - (2d_{min})^2}{2s_{ji}s_{hh}}\right)\right]_{min} \quad \text{(formula 8)}$$

where $\beta_{min}^{high}$ is the sixth angle, $s_{ji}$, is a distance between a position of $a_j$ at a current moment and the position of $a_i$ when the minimum distance occurs, and $s_{jj}$ is a distance between the position of $a_j$ at the current moment and the position of $a_j$ when the minimum distance occurs.

In a second aspect, an embodiment of the present disclosure provides a flight conflict resolution apparatus based on ultimatum game theory, including a first obtaining module, a first determining module, a second determining module and a third determining module, where the first obtaining module is configured to obtain a first priority of a first aircraft and a second priority of a second aircraft when it is determined that a minimum distance between the first aircraft and the second aircraft within a preset time period is less than a preset distance;

the first determining module is configured to determine a first angle and a second angle of the first aircraft and a fourth angle and a fifth angle of the second aircraft according to the first priority, the second priority and a preset limiting deflection angle, where the first angle is a maximum acceptable deflection angle of the first aircraft, the second angle is an angle by which the first aircraft is desired to be deflected, the fourth angle is a maximum acceptable deflection angle of the second aircraft, and the fifth angle is an angle by which the second aircraft is desired to be deflected;

the second determining module is configured to determine a third angle of the first aircraft and a sixth angle of the second aircraft, where the third angle is a deflection angle of the first aircraft causing the minimum distance between the first aircraft and the second aircraft within the preset time period greater than or equal to the preset distance when the second aircraft is not deflected, and the sixth angle is a deflection angle of the second aircraft causing the minimum distance between the first aircraft and the second aircraft within the preset time period greater than or equal to the preset distance when the first aircraft is not deflected;

the third determining module is configured to determine a first deflection angle of the first aircraft and a second deflection angle of the second aircraft according to the first priority, the second priority, the first angle, the second angle, the third angle, the fourth angle, the fifth angle and the sixth angle.

In a possible implementation, the third determining module is specifically configured to:

determine a first negotiation angle of the first aircraft among the first angle, the second angle and the third angle according to the first priority and the second priority;

determine a second negotiation angle of the second aircraft among the fourth angle, the fifth angle and the sixth angle according to the first priority and the second priority;

determine a first deflection angle and a second deflection angle according to the first priority, the second priority, the first negotiation angle, the second negotiation angle, the first angle and the fourth angle.

In another possible implementation, the second priority is greater than the first priority, and the third determining module is specifically configured to:

determine the first negotiation angle according to the following formula 1:

$$\beta_{P_{a_j}} = \begin{cases} \beta_{P_{a_j}}^{max}, \text{ when } \beta_{min}^{low} > \beta_{P_{a_j}}^{max} \text{ and } \beta_{Q_{a_i}}^{max} < \beta_{min}^{low} \\ \beta_{min}^{low}, \text{ when } \beta_{Q_{a_i}}^{max} > \beta_{min}^{low} > \beta_{P_{a_j}}^{max} \\ \beta_{min}^{low}, \text{ when } \beta_{min}^{low} < \beta_{P_{a_j}}^{max} \end{cases} \quad \text{(formula 1)}$$

where $$\beta_{P_{a_j}}$$

is the first negotiation angle, $a_j$ is the second aircraft, $$\beta_{P_{a_j}}^{max}$$

is the second angle $\beta_{min}^{low}$ is the third angle, and $$\beta_{Q_{a_i}}^{max}$$

is the first angle;

determine the second negotiation angle according to the following formula 2:

$$\beta_{P_{a_i}} = \min\{\beta_{min}^{high}, \beta_{P_{a_i}}^{max}\} \quad \text{(formula 2)}$$

where $$\beta_{P_{a_i}}$$

is the second negotiation angle, $a_i$ is the first aircraft, $\beta_{min}^{high}$ is the sixth angle, and $$\beta_{P_{a_i}}^{max}$$

is the fifth angle.

In another possible implementation, the third determining module is specifically configured to:

determine whether the first negotiation angle is less than the first angle;

if yes, determine that the first deflection angle is the first negotiation angle, and the second deflection angle is zero;

if no, determine whether the minimum distance between the first aircraft and the second aircraft within the preset time period is less than the preset distance when the first aircraft is deflected by the first angle, if no, determine that the first deflection angle is the first angle and the second deflection angle is zero, and if yes, determine the first deflection angle and the second deflection angle according to the second negotiation angle and the fourth angle.

In another possible implementation, the third determining module is specifically configured to:

determine whether the second negotiation angle is less than the fourth angle;

if yes, determine that the first deflection angle is the first angle, and the second deflection angle is the second negotiation angle;

If no, determine that the second deflection angle is the fourth angle, and determine the first deflection angle according to the fourth angle and flight information of the first aircraft and the second aircraft.

In another possible implementation, the first determining module is configured to:

determine the first angle according to the following formula 3:

$$\beta_{Q_{a_i}}^{max} = \pm\left|\beta \times \frac{n_i}{M}\right| \quad \text{(formula 3)}$$

where $$\beta_{Q_{a_i}}^{max}$$

is me first angle, β is me preset limiting deflection angle, M is a total number of aircrafts in an airspace, and $n_i$ is a priority ordinal number of the first aircraft;

determine the second angle according to the following formula 4:

$$\beta_{P_{a_j}}^{max} = \pm\left|\beta \times \frac{M - n_j}{M}\right| \quad \text{(formula 4)}$$

where $$\beta_{P_{a_j}}^{max}$$

is the second angle, and $n_j$ is a priority ordinal number of the second aircraft;

determine the fourth angle according to the following formula 5:

$$\beta_{Q_{a_j}}^{max} = \pm\left|\beta \times \frac{n_j}{M}\right| \quad \text{(formula 5)}$$

where $$\beta_{Q_{a_j}}^{max}$$

is the fourth angle;

determine the fifth angle according to the following formula 6:

$$\beta_{P_{a_i}}^{max} = \pm\left|\beta \times \frac{M - n_i}{M}\right| \quad \text{(formula 6)}$$

where $$\beta_{P_{a_i}}^{max}$$

is the fifth angle.

In another possible implementation, the second determining module is configured to:

determine the third angle according to the following formula 7:

$$B_{min}^{low} = \left[\cos^{-1}\left(\frac{s_{ij}^2 + s_{ii}^2 - (2R_a)^2}{2s_{ij}s_{ii}}\right) - \cos^{-1}\left(\frac{s_{ij}^2 + s_{ii}^2 - (2d_{\min})^2}{2s_{ij}s_{ii}}\right)\right]_{min} \quad \text{(formula 7)}$$

where $\beta_{min}^{low}$ is the third angle, $d_{min}$ is a minimum distance between $a_i$ and $a_j$ in a future preset time period, $s_{ij}$ is a distance between a position of $a_i$ at a current moment and a position of $a_j$ when the minimum distance occurs, and $s_{ii}$ is a distance between the position of $a_i$ at the current moment and a position of $a_i$ when the minimum distance occurs, $R_a$ is the preset distance;

determine the sixth angle according to the following formula 8:

$$\beta_{min}^{high} = \left[\cos^{-1}\left(\frac{s_{ji}^2 + s_{jj}^2 - (2R_a)^2}{2s_{ji}s_{jj}}\right) - \cos^{-1}\left(\frac{s_{ji}^2 + s_{jj}^2 - (2d_{min})^2}{2s_{ji}s_{jj}}\right)\right]_{min} \quad \text{(formula 8)}$$

where $\beta_{min}^{high}$ is the sixth angle, $s_{ji}$, is a distance between a position of $a_j$ at a current moment and the position of $a_i$ when the minimum distance occurs, and $s_{jj}$ is a distance between the position of $a_j$ at the current moment and the position of $a_j$ when the minimum distance occurs.

In a third aspect, an embodiment of the present disclosure provides a flight conflict resolution apparatus based on ultimatum game theory, including: a processor coupled to a memory;

the memory is configured to store a computer program;

the processor is configured to execute the computer program stored in the memory, so as to cause a flight conflict resolution apparatus based on ultimatum game theory to perform any one of the methods according to the above first aspect.

In a fourth aspect, an embodiment of the present disclosure provides a readable storage medium, including a program or an instruction, where when the program or the instruction is running on a computer, any one of the methods according to the above first aspect is executed.

In the flight conflict resolution method and apparatus based on ultimatum game theory according to the embodiments of the present disclosure, the first priority of the first aircraft and the second priority of the second aircraft are obtained when it is determined that the minimum distance between the first aircraft and the second aircraft within the preset time period is less than a preset distance; the first angle and the second angle of the first aircraft and the fourth angle and the fifth angle of the second aircraft are determined according to the first priority, the second priority and the preset limiting deflection angle; the third angle of the first aircraft and the sixth angle of the second aircraft are determined; the first deflection angle of the first aircraft and the second deflection angle of the second aircraft are determined according to the first priority, the second priority, the first angle, the second angle, the third angle, the fourth angle, the fifth angle and the sixth angle. In the above process, when the minimum distance between the aircrafts within the preset time period is less than the preset distance, there is a flight conflict between the aircrafts, then the first priority and the second priority of the aircraft in the flight conflict are obtained, and then the first angle, the second angle, the third angle, the fourth angle, the fifth angle, the sixth angle, the first deflection angle and the second deflection angle are sequentially determined, and finally the aircrafts in the conflict negotiate according to the determined angles, and at the same time, the aircrafts are deflected according to a result of the negotiation, so that the minimum distance between the aircrafts within the preset time period is greater than or equal to the preset distance, thereby avoiding the flight conflict between the aircrafts, and improving the flight safety of the aircrafts.

BRIEF DESCRIPTION OF THE DRAWINGS

In order to illustrate technical solutions in the embodiments of the present disclosure or in the prior art more clearly, the drawings required for describing the embodiments or the prior art will be briefly introduced below. Obviously, the drawings described below are some embodiments of the present disclosure, and persons of ordinary skill in the art may still obtain other drawings from these drawings without any creative effort.

DETAILED DESCRIPTION OF THE EMBODIMENTS

To make the purpose, technical solutions, and advantages of the embodiments of the present disclosure clearer, the technical solutions in the embodiments of the present disclosure are clearly and completely described with reference to the drawings in the embodiments of the present disclosure below. Apparently, the described embodiments are some but not all of the embodiments of the present disclosure. All other embodiments obtained by persons of ordinary skill in the art based on the embodiments of the present disclosure without any creative effort shall fall within the protection scope of the present disclosure.

Figure 1:
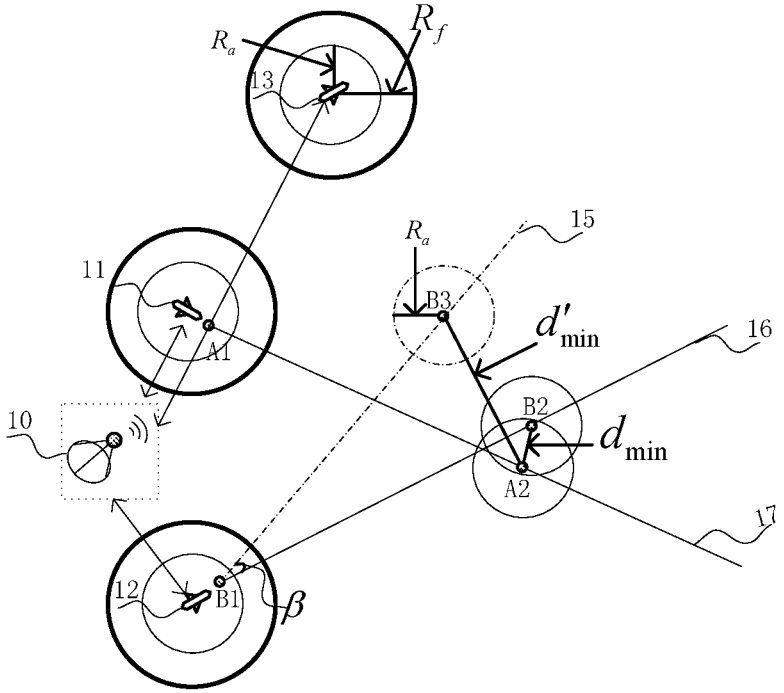
FIG. 1 is a schematic diagram of an application scenario of a flight conflict resolution method based on ultimatum game theory according to an embodiment of the present disclosure.

FIG. 1 is a schematic diagram of an application scenario of a flight conflict resolution method based on ultimatum game theory according to an embodiment of the present disclosure. Referring to FIG. 1, an air traffic management device 10, a first aircraft 11, a second aircraft 12 and a third aircraft 13 are included, where the first aircraft 11, the second aircraft 12 and the third aircraft 13 all can communicate with the air traffic management device 10.

Optionally, the first aircraft 11 can have a flight route 17 and the second aircraft 12 can have a flight route 16.

Optionally, the first aircraft 11, the second aircraft 12 and the third aircraft 13 in an airspace can detect whether there is an obstacle in a circular area with a respective body as a center and $R_f$ as a radius.

Optionally, the first aircraft 11, the second aircraft 12 and the third aircraft 13 can feed a detection result and a flight conflict back to the air traffic management device 10.

Optionally, the air traffic management device 10 may determine whether there is a flight conflict between the first aircraft 11, the second aircraft 12 and the third aircraft 13 in a future preset time period, and make a flight instruction to an aircraft in the flight conflict.

Optionally, the flight conflict may be a conflict between aircrafts.

For example, when aircrafts are flying on their flight routes, there is a conflict between the aircrafts when a minimum distance $d_{min}$ between the aircrafts within the future preset time period is less than a preset distance $R_a$.

Optionally, the preset distance $R_a$ may be a radius of a risky proximity region of the first aircraft 11, the second aircraft 12 and the third aircraft 13 when flying, where the risky proximity region is a circular area in which the respective aircraft takes its own body as a center and $R_a$ as a radius.

Optionally, the flight instruction may be an instruction that causes an aircraft to change its flight angle to resolve the flight conflict.

Optionally, in a process of solving the flight conflict, the problem of extricating the flight conflict is regarded as a process of multi-aircraft game.

For example, in an actual application, the air traffic management device 10 acquires, by predicting a flight state of each aircraft according to the route and the flight speed of each aircraft, that the minimum distance $d_{min}$ between the first aircraft 11 at a position A2 and the second aircraft 12 at a position B2 within the future preset time period is less than the preset distance $R_a$, thus there is a flight conflict between the first aircraft 11 and the second aircraft 12 within the future preset time period, and the air traffic management device 10 then gives a flight instruction to the second aircraft 12 to cause the second aircraft 12 to deflect by an angle β, such that the second aircraft 12 changes its route to route 15 in the future preset time period, and the position of the second aircraft 12 at a moment when the minimum distance $d_{min}$ occurs changes from B2 to B3. After the second aircraft 12 changes the flight angle, $d_{min}$ between the first aircraft 11 at the position A2 and the second aircraft 12 at the position B3 within the future preset time period are greater than or equal to the preset distance $R_a$, that is, the flight conflict between the first aircraft 11 and the second aircraft 12 is avoided.

In the present application, the flight conflict between aircrafts is avoided by the air traffic management device instructing an aircraft in the flight conflict to change the flight angle, thereby improving the flight safety of the aircrafts.

Hereinafter, the technical solutions as directed by the present application are described in detail with reference to specific embodiments. It should be noted that the following specific embodiments may be combined with each other, and same or similar contents will not be repeatedly described in different embodiments.

Figure 2:
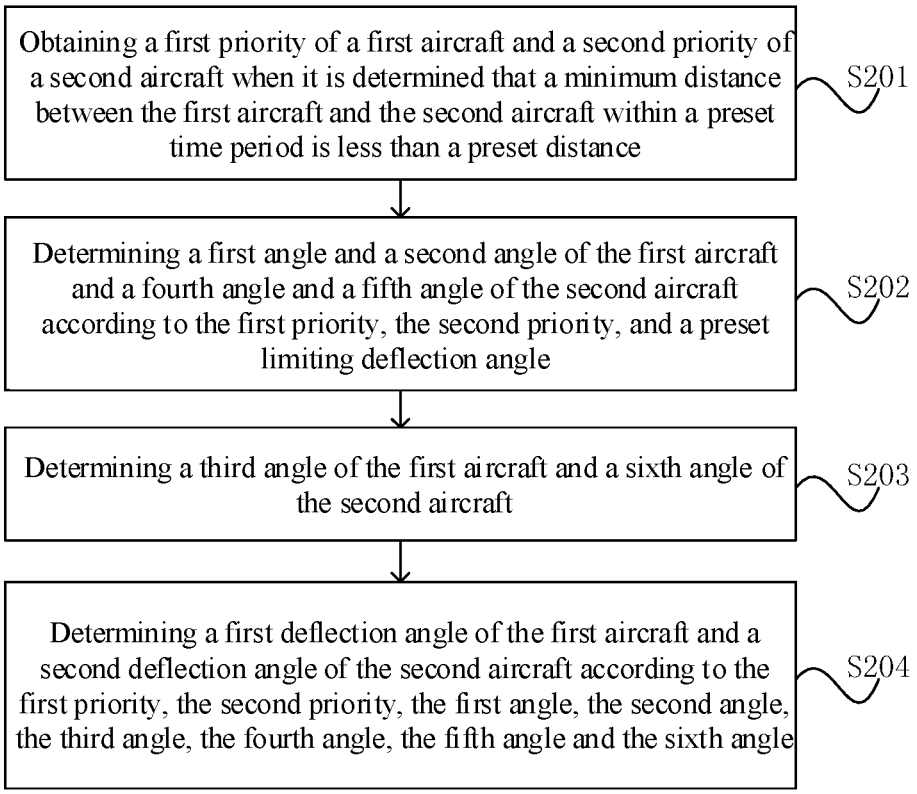
FIG. 2 is a schematic diagram of a flow chart of a flight conflict resolution method based on ultimatum game theory according to an embodiment of the present disclosure.

FIG. 2 is a schematic diagram of a flow chart of a flight conflict resolution method based on ultimatum game theory according to an embodiment of the present disclosure. Referring to FIG. 2, the method can include:

S201: obtaining a first priority of a first aircraft and a second priority of a second aircraft when it is determined that a minimum distance between the first aircraft and the second aircraft within a preset time period is less than a preset distance.

The executive body of the embodiment of the present disclosure may be an air traffic management device or a flight conflict resolution apparatus based on ultimatum game theory in an air traffic management device. Optionally, the flight conflict resolution apparatus based on ultimatum game theory may be achieved by software, or the flight conflict resolution apparatus based on ultimatum game theory may also be achieved by a combination of software and hardware.

Optionally, the first aircraft and the second aircraft may be civilian passenger aircrafts flying in the airspace.

Optionally, for the sake of clarity, the first aircraft is represented by $a_i$ and the second aircraft is represented by $a_j$.

Optionally, the preset time period is a time period during future flights of $a_i$ and $a_j$.

For example, the preset time period may be one hour, or two hours, or the like, during the future flights of $a_i$ and $a_j$.

Optionally, the minimum distance between $a_i$ and $a_j$ within the preset time period is $d_{min}$.

Optionally, when the minimum distance $d_{min}$ is less than a preset distance $R_a$, there is a flight conflict between $a_i$ and $a_j$, and when the minimum distance $d_{min}$ greater than or equal to the preset distance $R_a$ there is no flight conflict between $a_i$ and $a_j$.

Optionally, the air traffic management device can prioritize aircrafts flying in the airspace under its jurisdiction to determine a set of priorities of the aircrafts.

Optionally, a feasible priority ordering method is as follows: firstly, a first priority ordering is performed according to a distance of a current aircraft from a destination, where the closer a current position of the aircraft is to the destination, the higher its priority is; secondly, subsequent to the first priority ordering, in the case of a same distance from the destination, a second priority ordering is performed according to a current flight delay time of an aircraft, where the longer the delay time of the aircraft is, the higher its priority is; thirdly, subsequent to the second priority ordering, in the case of a same delay time, a third priority ordering is performed according to a current flight duration of an aircraft, where the longer the flight duration of the aircraft is, the higher its priority is; finally, subsequent to the third priority ordering, in the case of a same flight duration, a fourth priority ordering is performed according to an intended flight time for a remaining flight, where the longer the intended flight time for the remaining flight of the aircraft is, the higher its priority is.

Optionally, an aircraft with a higher priority is more inclined to consider its own interest, and an aircraft with a lower priority is more inclined to consider the interest of the aircraft with the higher priority.

Optionally, a self-interest of an aircraft with a higher priority is that, when changing its flight deflection angle, it is always desirable that the aircraft itself is deflected by a minimum angle, and other aircrafts are deflected by an angle as large as possible.

It should be noted that the above is only an illustrative example of a priority ordering method, which is not a limitation of the priority ordering method. In an actual application process, the priority ordering method may be determined according to actual needs. This is not specifically limited by embodiments of the present disclosure.

Optionally, the first priority of $a_i$ and the second priority of $a_j$ are determined according to the set of priorities of the aircrafts.

Optionally, the first priority and the second priority may be priority ordinal numbers such as 0, 1, 2, or the like.

For example, the air traffic management device determines that a set of priorities of aircrafts $a_1$, $a_2$, $a_3$ and $a_4$ is (3, 1, 2, 0). That is, aircraft $a_1$ has a lowest priority, and its priority ordinal number is 3, aircraft $a_3$ has a lower priority, and its priority ordinal number is 2, aircraft $a_2$ has a higher priority, and its priority ordinal number is 1, and aircraft $a_4$ has a highest priority, and its priority ordinal number is 0.

S202: determining a first angle and a second angle of the first aircraft and a fourth angle and a fifth angle of the second aircraft according to the first priority, the second priority and a preset limiting deflection angle.

The first angle is a maximum acceptable deflection angle of the first aircraft, the second angle is an angle by which the first aircraft is desired to be deflected, the fourth angle is a maximum acceptable deflection angle of the second aircraft, and the fifth angle is an angle by which the second aircraft is desired to be deflected.

Optionally, there is an ultimatum game strategy ($P_{a_i}$, $Q_{a_i}$) for $a_i$, where $P_{a_i}$ is a magnitude of a deflection angle by which $a_i$ desires $a_j$ to be deflected, and $Q_{a_i}$ is a magnitude of an acceptable maximum deflection angle of $a_i$.

Optionally, $Q_{a_i}$ may be determined by the following feasible formula 9:

$$Q_{a_i} = \frac{n_i}{M} \quad \text{(formula 9)}$$

where M is a total number of the aircrafts in the airspace (i.e., a total number of the aircrafts in the airspace under the jurisdiction of the air traffic management device), $n_i$ is a priority ordinal number of $a_i$, and a value of $n_i$ may be 0, 1, 2, or the like.

Optionally, $P_{a_i}$ may be determined by the following feasible formula 10:

$$P_{a_j} = \frac{M - n_j}{M} \quad \text{(formula 10)}$$

where $n_j$ is a priority ordinal number of $a_j$, and $a_i$ value of $n_j$ may be 0, 1, 2, or the like.

Optically, there is an ultimatum game strategy ($P_{a_j}$, $Q_{a_j}$) for $a_j$, where $P_{a_i}$ is a magnitude of a deflection angle by which $a_j$ desires $a_i$ to be deflected, and $Q_{a_j}$ is a magnitude of an acceptable maximum deflection angle of $a_j$.

Optically, $P_{a_i}$ may be determined by the following feasible formula 11:

$$P_{a_i} = \frac{M - n_i}{M} \quad \text{(formula 11)}$$

Optically, $Q_{a_j}$, may be determined by the following feasible formula 12:

$$Q_{a_j} = \frac{n_j}{M} \quad \text{(formula 12)}$$

where value ranges of $P_{a_j}$, $Q_{a_i}$, $P_{a_i}$, and $Q_{a_j}$ is greater than or equal to zero and less than or equal to one.

Optionally, the preset limiting deflection angle is an absolute value of a maximum limiting deflection angle of all aircrafts (including the first aircraft and the second aircraft) in the airspace. It should be noted that all the aircrafts are aircrafts flying in the airspace under the jurisdiction of the air traffic management device.

Optionally, the second angle is an angle by which $a_j$ desires $a_i$ to be deflected.

Optionally, the fifth angle is an angle by which $a_i$ desires $a_j$ to be deflected.

Optionally, the first angle may be determined according to the following feasible formula 3:

$$B_{Q_{a_i}}^{max} = \pm\left|\beta \times \frac{M - n_i}{M}\right| \quad \text{(formula 3)}$$

where $$B_{Q_{a_i}}^{max}$$

is the first angle, β is the preset limiting deflection angle, a value of $$\frac{n_i}{M}$$

is $Q_{a_i}$;

Optionally, the second angle may be determined according to the following feasible formula 4:

$$\beta_{P_{a_j}}^{max} = \pm\left|\beta \times \frac{M - n_j}{M}\right| \quad \text{(formula 4)}$$

where $$\beta_{P_{a_j}}^{max}$$

is the second angle, and a value of $$\frac{M - n_j}{M}$$

is $P_{a_j}$.

Optionally, the fourth angle may be determined according to the following feasible formula 5:

$$\beta_{Q_{a_j}}^{max} = \pm\left|\beta \times \frac{n_j}{M}\right| \quad \text{(formula 5)}$$

where $$\beta_{Q_{a_j}}^{max}$$

is the fourth angle, and a value of $$\frac{n_j}{M}$$

is $Q_{a_j}$.

Optionally, the fifth angle may be determined according to the following feasible formula 6:

$$\beta_{P_{a_i}}^{max} = \pm\left|\beta \times \frac{M - n_i}{M}\right| \quad \text{(formula 6)}$$

where $$\beta_{P_{a_i}}^{max}$$

is the fifth angle, and a value of $$\frac{M - n_i}{M}$$

is $P_{a_i}$.

S203: determining a third angle of the first aircraft and a sixth angle of the second aircraft.

The third angle is a deflection angle of the first aircraft causing the minimum distance between the first aircraft and the second aircraft within the preset time period greater than or equal to the preset distance when the second aircraft is not deflected, and the sixth angle is a deflection angle of the second aircraft causing the minimum distance between the first aircraft and the second aircraft within the preset time period greater than or equal to the preset distance when the first aircraft is not deflected.

Optionally, when the first aircraft is deflected by the third angle, the conflict between the first aircraft and the second aircraft can be avoided without a deflection of the second aircraft.

Optionally, when the second aircraft is deflected by the sixth angle, the conflict between the first aircraft and the second aircraft can be avoided without a deflection of the first aircraft.

Optionally, the third angle may be determined according to the following feasible formula 7:

$$B_{min}^{low} = \left[\cos^{-1}\left(\frac{s_{ij}^2 + s_{ii}^2 - (2R_a)^2}{2s_{ij}s_{ii}}\right) - \cos^{-1}\left(\frac{s_{ij}^2 + s_{ii}^2 - (2d_{min})^2}{2s_{ij}s_{ii}}\right)\right]_{min} \quad \text{(formula 7)}$$

where $\beta_{min}^{low}$ is the third angle, $d_{min}$ is the minimum distance between $a_i$ and $a_j$ in a future preset time period, $s_{ij}$ is a distance between a position of $a_i$ at a current moment and a position of $a_j$ when the minimum distance occurs, and $s_{ii}$ is a distance between the position of $a_i$ at the current moment and a position of $a_i$ when the minimum distance occurs, $R_a$ is the preset distance.

Optionally, the sixth angle may be determined according to the following feasible formula 8:

$$\beta_{min}^{high} = \left[\cos^{-1}\left(\frac{s_{ji}^2 + s_{jj}^2 - (2R_a)^2}{2s_{ji}s_{jj}}\right) - \cos^{-1}\left(\frac{s_{ji}^2 + s_{jj}^2 - (2d_{min})^2}{2s_{ji}s_{jj}}\right)\right]_{min} \quad \text{(formula 8)}$$

where $\beta_{min}^{high}$ is the sixth angle, $s_{ji}$, is a distance between a position of $a_j$ at a current moment and the position of $a_i$ when the minimum distance occurs, and $s_{jj}$ is a distance between the position of $a_j$ at the current moment and the position of $a_j$ when the minimum distance occurs.

On the basis of any one of the above embodiments, optionally, the third angle and the sixth angle may be determined by the following feasible implementation. Specifically, reference is made to embodiments shown in FIG. 3A and FIG. 3B.

Figure 3A:
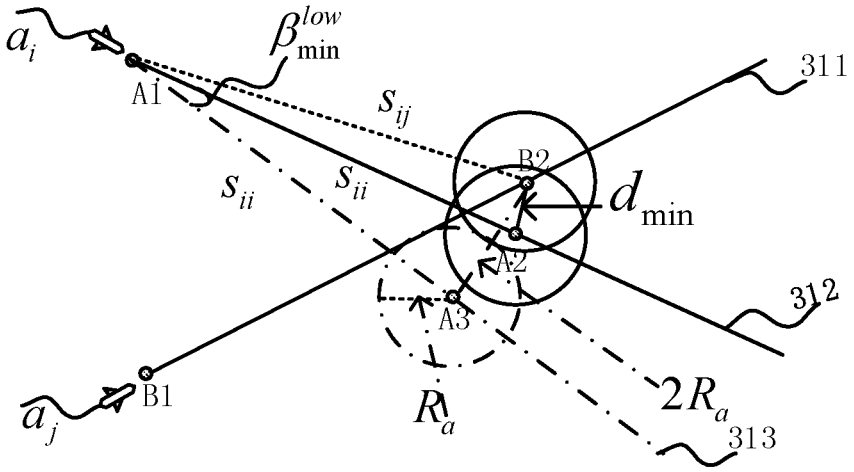
FIG. 3A is a geometric schematic diagram of determining a third angle according to an embodiment of the present disclosure.

FIG. 3A is a geometric schematic diagram of determining the third angle according to an embodiment of the present disclosure.

Referring to FIG. 3A, $a_i$ is flying on a fixed route 312, and $a_j$ is flying on a fixed route 311. At a moment in the future preset time period, there is a flight conflict between $a_i$ and $a_j$ (i.e., the minimum distance $d_{min}$ between $a_i$ and $a_j$ is less than $R_a$), then the route of $a_j$ remains unchanged, and the flight angle of $a_i$ is deflected by $\beta_{min}^{low}$ with its route updated to a route 313. That is, at that moment in the future time period, a position of $a_i$ is updated from A2 to A3, such that the minimum distance $d_{min}$ between $a_j$ and $a_i$ is greater than or equal to $R_a$, thereby solving the flight conflict between $a_j$ and $a_i$.

In FIG. 3A, $s_{ij}$ is a distance between a position A1 of $a_i$ at the current moment and a position B2 of $a_j$ when the minimum distance $d_{min}$ occurs, $s_{ii}$ is a distance between the position A1 of $a_i$ at the current moment and the position A2 of $a_i$ when the minimum distance $d_{min}$ occurs, and $s_{ii}$ is also a distance between the position A1 of $a_i$ at the current moment and the updated position A3 of $a_i$.

Figure 3B:
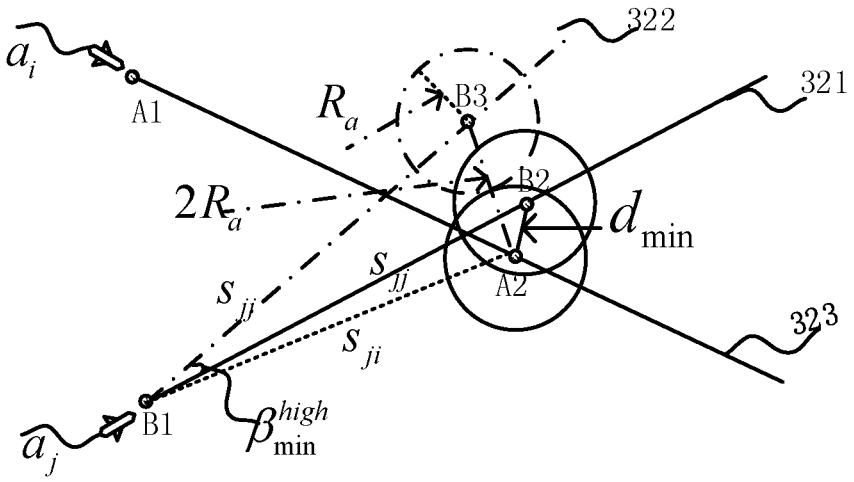
FIG. 3B is a geometric schematic diagram of determining a sixth angle according to an embodiment of the present disclosure.

FIG. 3B is a geometric schematic diagram of determining the sixth angle according to an embodiment of the present disclosure.

Referring to FIG. 3B, $a_i$ is flying on a fixed route 323, $a_j$ is flying on a fixed route 321. At a moment in the future preset time period, there is a flight conflict between $a_i$ and $a_j$ (i.e., the minimum distance d between $a_i$ and $a_j$ is less than $R_a$), then the route of $a_i$ remains unchanged, and the flight angle of $a_j$ is deflected by $\beta_{min}^{high}$ with its route updated to a route 322. That is, at that moment in the future time period, a position of $a_j$ is updated from B2 to B3, such that the minimum distance d between $a_j$ and $a_i$ is greater than or equal to $R_a$, thereby solving the flight conflict between $a_j$ and $a_i$.

In FIG. 3B, $s_{ji}$ is a distance between a position B1 of $a_j$ at the current moment and a position A2 of $a_i$ when the minimum distance $d_{min}$ occurs, $s_{jj}$ is a distance between the position B1 of $a_j$ at the current moment and the position B2 of $a_j$ when the minimum distance $d_{min}$ occurs, and $s_{jj}$ is also a distance between the position B1 of $a_j$ at the current moment and the updated position B3 of $a_j$.

S204: determining a first deflection angle of the first aircraft and a second deflection angle of the second aircraft according to the first priority, the second priority, the first angle, the second angle, the third angle, the fourth angle, the fifth angle and the sixth angle.

Optionally, according to the first priority and the second priority, a first negotiation angle of $a_i$ may be determined among the first angle, the second angle and the third angle, and a second negotiation angle of $a_j$ may be determined among the fourth angle, the fifth angle and the sixth angle.

Optionally, the first deflection angle and the second deflection angle may be determined according to the first priority, the second priority, the first negotiation angle, the second negotiation angle, the first angle and the fourth angle.

Optionally, when the second priority is greater than the first priority, the first negotiation angle may be determined according to the following feasible formula 1:

$$\beta_{P_{a_j}} = \begin{cases} \beta_{P_{a_j}}^{max}, & \text{when } \beta_{min}^{low} > \beta_{P_{a_j}}^{max} \text{ and } \beta_{Q_{a_i}}^{max} < \beta_{min}^{low} \\ \beta_{min}^{low}, & \text{when } \beta_{Q_{a_i}}^{max} > \beta_{min}^{low} > \beta_{P_{a_i}}^{max} \\ \beta_{min}^{low}, & \text{when } \beta_{min}^{low} < \beta_{P_{a_j}}^{max} \end{cases} \quad \text{(formula 1)}$$

where $$\beta_{P_{a_j}}$$

is the first negotiation angle, $$\beta_{P_{a_j}}^{max}$$

is the second angle, $\beta_{min}^{low}$ is the third angle, and $$\beta_{Q_{a_i}}^{max}$$

is the first angle.

Optionally, the second negotiation angle may be determined according to the following feasible formula 2:

$$\beta_{P_{a_i}} = \min\{\beta_{min}^{high}, \beta_{P_{a_i}}^{max}\} \quad \text{(formula 2)}$$

where $$\beta_{P_{a_i}}$$

is the second negotiation angle, $\beta_{min}^{high}$ is the sixth angle, and $$\beta_{P_{a_i}}^{max}$$

is the fifth angle.

Figure 4:
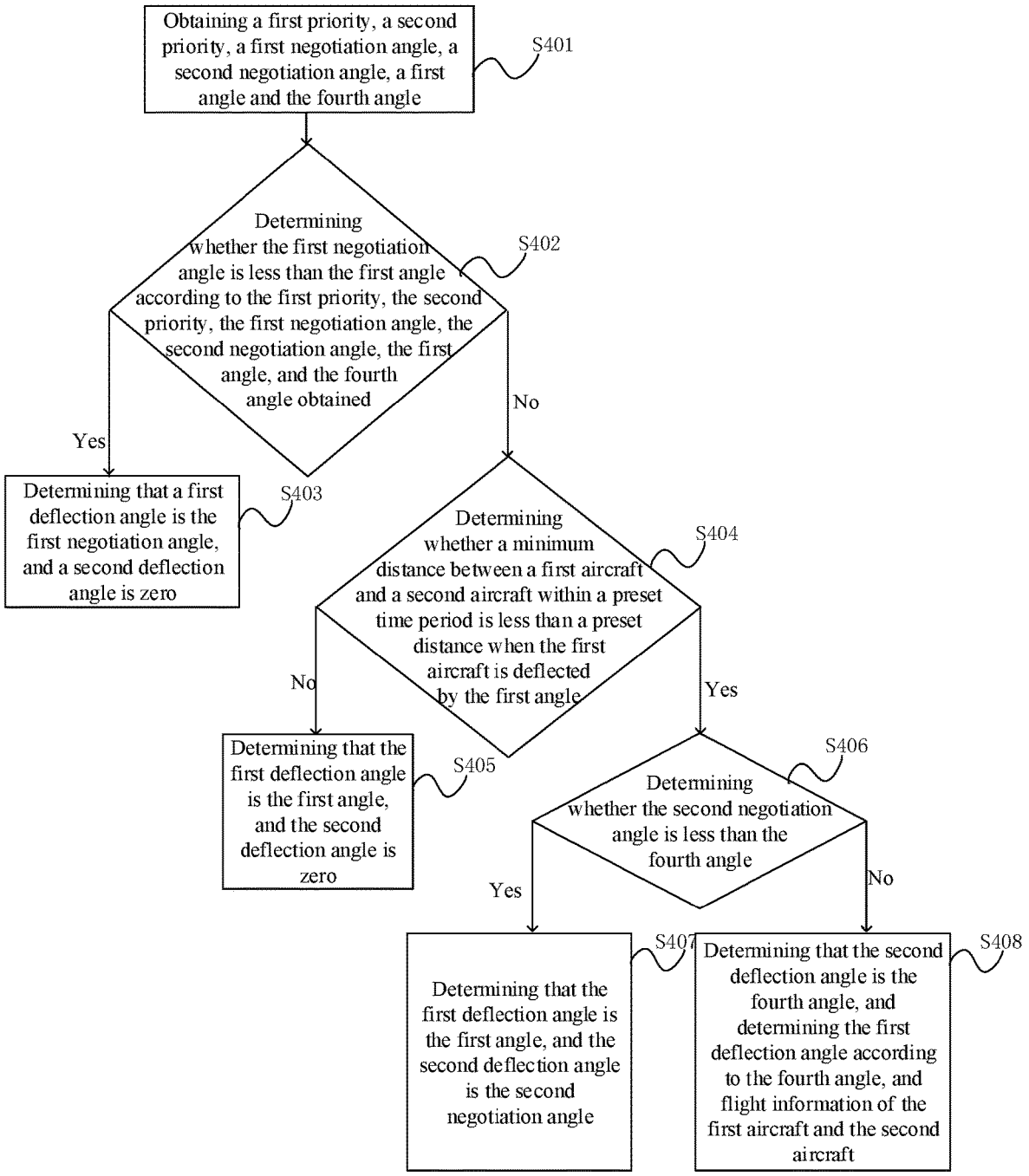
FIG. 4 is a schematic diagram of a method for determining a first deflection angle and a second deflection angle according to an embodiment of the present disclosure.

It should be noted that, in an embodiment shown in FIG. 4, a manner in which the first deflection angle and the second deflection angle are determined according to the first priority, the second priority, the first negotiation angle, the second negotiation angle, the first angle and the fourth angle is described in detail, and details will not be repeatedly described here.

In the flight conflict resolution method based on ultimatum game theory according to the embodiments of the present disclosure, the first priority of the first aircraft and the second priority of the second aircraft are obtained when it is determined that the minimum distance between the first aircraft and the second aircraft within the preset time period is less than a preset distance; the first angle and the second angle of the first aircraft and the fourth angle and the fifth angle of the second aircraft are determined according to the first priority, the second priority and the preset limiting deflection angle; the third angle of the first aircraft and the sixth angle of the second aircraft are determined; the first deflection angle of the first aircraft and the second deflection angle of the second aircraft are determined according to the first priority, the second priority, the first angle, the second angle, the third angle, the fourth angle, the fifth angle and the sixth angle. In the above process, when the minimum distance between the aircrafts within the preset time period is less than the preset distance, there is a flight conflict between the aircrafts, then the first priority and the second priority of the aircraft in the flight conflict are obtained, and then the first angle, the second angle, the third angle, the fourth angle, the fifth angle, the sixth angle, the first deflection angle and the second deflection angle are sequentially determined, and finally the aircrafts in the conflict negotiate according to the determined angles, and at the same time, the aircrafts are deflected according to a result of the negotiation, so that the minimum distance between the aircrafts within the preset time period is greater than or equal to the preset distance, thereby avoiding the flight conflict between the aircrafts, and improving the flight safety of the aircrafts.

Based on any one of the above embodiments, hereinafter, a method for determining the first deflection angle and the second deflection angle will be described in detail with reference to FIG. 4.

FIG. 4 is a schematic diagram of a method for determining a first deflection angle and a second deflection angle according to an embodiment of the present disclosure. Reference is made to FIG. 4.

In a possible implementation, a method for determining a first deflection angle and a second deflection angle includes:

S401: obtaining a first priority, a second priority, a first negotiation angle, a second negotiation angle, a first angle and a fourth angle.

It should be noted that the execution process of S201-S204 in the embodiment of FIG. 2 can be referred to for the execution process of S401, and details will not be repeatedly described here.

S402: determining whether the first negotiation angle is less than the first angle.

If yes, S403 is executed.

If no, S404 is executed.

It should be noted that, proposing the first negotiation angle $$\beta_{P_{a_j}}$$

by $a_j$ to $a_i$, and determining whether the first negotiation angle $$\beta_{P_{a_j}}$$

is less than the first angle $$\beta_{Q_{a_i}}^{max}$$

is to determine whether the first negotiation angle $$\beta_{P_{a_j}}$$

proposed by $a_j$ to $a_i$ is within a maximum acceptable deflection range of $a_i$.

S403: determining that a first deflection angle is the first negotiation angle, and a second deflection angle is zero.

Optionally, if the first negotiation angle $$\beta_{P_{a_j}}$$

proposed by $a_j$ to $a_i$ is less than the first angle $$\beta_{Q_{a_i}}^{max},$$

that is, the first negotiation angle $$\beta_{P_{a_j}}$$

proposed by $a_j$ to $a_i$ is within the maximum acceptable range of $a_i$, then the first deflection angle of $a_i$ is the first negotiation angle $$\beta_{P_{a_j}},$$

and the second deflection angle of $a_j$ is zero, that is, $a_i$ is deflected by the first negotiation angle $$\beta_{P_{a_j}}$$

for flying, and $a_j$ does not change its route.

S404: determining whether a minimum distance between a first aircraft and a second aircraft within a preset time period is less than a preset distance when the first aircraft is deflected by the first angle.

If no, S405 is executed.

If yes, S406 is executed.

Optionally, since the first negotiation angle $$\beta_{P_{a_j}}$$

proposed by $a_j$ to $a_i$ is greater than or equal to the first angle $$\beta_{Q_{a_i}}^{max},$$

that is, the first negotiation angle $$\beta_{P_{a_j}}$$

proposed by $a_j$ to $a_i$ is not within the maximum acceptable range of $a_i$, then, $a_i$ is deflected by the first angle $$\beta_{Q_{a_i}}^{max}$$

for flying, and it is determined that whether the minimum distance between $a_i$ and $a_j$ within the preset time period is less than the preset distance, that is, in the case where $a_i$ is deflected by the first angle $$\beta_{Q_{a_i}}^{max}$$

for flying, it is determined that whether there is a flight conflict between $a_i$ and $a_j$ within the preset time period.

S405: determining that the first deflection angle is the first angle, and the second deflection angle is zero.

Optionally, when $a_i$ is deflected by the first angle $$\beta_{Q_{a_i}}^{max}$$

for flying, if there is no flight conflict between $a_i$ and $a_j$ within the preset time period, then the first deflection angle of $a_i$ is the first angle $$\beta_{Q_{a_i}}^{max},$$

and the second deflection angle of $a_j$ is zero, that is, $a_i$ is deflected by the first angle $$\beta_{Q_{a_i}}^{max}$$

for flying, and $a_j$ does not change its route.

S406: determining whether the second negotiation angle is less than the fourth angle.

If yes, S407 is executed.

If no, S408 is executed.

Optionally, when $a_i$ is deflected by the first angle $$\beta_{Q_{a_i}}^{max}$$

for flying, if there is a flight conflict between $a_i$ and $a_j$ within the preset time period, then the second negotiation angle $$\beta_{P_{a_i}}$$

is proposed by $a_i$ to $a_j$.

S407: determining that the first deflection angle is the first angle, and the second deflection angle is the second negotiation angle.

Optionally, if the second negotiation angle $$\beta_{P_{a_i}}$$

is less than the fourth angle $$\beta_{Q_{a_j}}^{max},$$

that is, the second negotiation angle $$\beta_{P_{a_i}}$$

proposed by $a_i$ to $a_j$ is within a maximum acceptable range of $a_j$, then the first deflection angle of $a_i$ is the first angle $$\beta_{Q_{a_i}}^{max},$$

and the second deflection angle of $a_j$ is the second negotiation angle $$\beta_{P_{a_i}},$$

that is, $a_j$ is deflected by the first angle $$\beta_{Q_{a_i}}^{max}$$

for flying, and $a_j$ is deflected by the second negotiation angle $$\beta_{P_{a_i}}$$

for flying.

S408: determining that the second deflection angle is the fourth angle, and determining the first deflection angle according to the fourth angle, and flight information of the first aircraft and the second aircraft.

Optionally, if the second negotiation angle $$\beta_{P_{a_i}}$$

is greater than or equal to the fourth angle $$\beta_{Q_{a_j}}^{max},$$

that is, the second negotiation angle $$\beta_{P_{a_i}}$$

proposed by $a_i$ to $a_j$ is not within the maximum acceptable range of $a_j$, then the second deflection angle of $a_j$ is the fourth angle $$\beta_{Q_{a_j}}^{max},$$

that is, $a_j$ is deflected by the fourth angle $$\beta_{Q_{a_j}}^{max}$$

for flying.

Optionally, after $a_j$ is deflected by the fourth angle $$\beta_{Q_{a_j}}^{max},$$

$a_j$ has a new flight route. When $a_j$ is flying on the new flight route, a third deflection angle $\beta_{min}^{low}$ of $a_i$ is obtained by calculating using formula 7. Then, the first deflection angle of $a_i$ is the third deflection $\beta_{min}^{low}$, that is, $a_i$ is deflected by the third deflection angle $\beta_{min}^{low}$ for flying.

Figure 5:
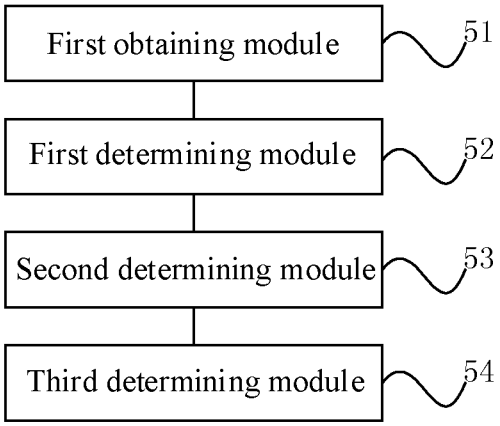
FIG. 5 is a schematic diagram of a flight conflict resolution apparatus based on ultimatum game theory according to an embodiment of the present disclosure.

FIG. 5 is a schematic diagram of a flight conflict resolution apparatus based on ultimatum game theory according to an embodiment of the present disclosure. Referring to FIG. 5, the apparatus may include a first obtaining module 51, a first determining module 52, a second determining module 53 and a third determining module 54, where the first obtaining module 51 is configured to obtain a first priority of a first aircraft and a second priority of a second aircraft when it is determined that a minimum distance between the first aircraft and the second aircraft within a preset time period is less than a preset distance;

the first determining module 52 is configured to determine a first angle and a second angle of the first aircraft and a fourth angle and a fifth angle of the second aircraft according to the first priority, the second priority and a preset limiting deflection angle, where the first angle is a maximum acceptable deflection angle of the first aircraft, the second angle is an angle by which the first aircraft is desired to be deflected, the fourth angle is a maximum acceptable deflection angle of the second aircraft, and the fifth angle is an angle by which the second aircraft is desired to be deflected;

the second determining module 53 is configured to determine a third angle of the first aircraft and a sixth angle of the second aircraft, where the third angle is a deflection angle of the first aircraft causing the minimum distance between the first aircraft and the second aircraft within the preset time period greater than or equal to the preset distance when the second aircraft is not deflected, and the sixth angle is a deflection angle of the second aircraft causing the minimum distance between the first aircraft and the second aircraft within the preset time period greater than or equal to the preset distance when the first aircraft is not deflected;

the third determining module 54 is configured to determine a first deflection angle of the first aircraft and a second deflection angle of the second aircraft according to the first priority, the second priority, the first angle, the second angle, the third angle, the fourth angle, the fifth angle and the sixth angle.

The flight conflict resolution apparatus based on ultimatum game theory according to the embodiment of the present disclosure can perform the technical solutions shown in the above method embodiments, and the implementation principle and the advantageous effect are similar, and details will not be repeatedly described here.

In a possible implementation, the third determining module 54 is specifically configured to:

determine a first negotiation angle of the first aircraft among the first angle, the second angle and the third angle according to the first priority and the second priority;

determine a second negotiation angle of the second aircraft among the fourth angle, the fifth angle and the sixth angle according to the first priority and the second priority;

determine a first deflection angle and a second deflection angle according to the first priority, the second priority, the first negotiation angle, the second negotiation angle, the first angle and the fourth angle.

In another possible implementation, the second priority is greater than the first priority, and the third determining module 54 is specifically configured to:

optionally, determine the first negotiation angle according to the following feasible formula 1:

$$\beta_{P_{a_j}} = \begin{cases} \beta_{P_{a_j}}^{max}, \text{ when } \beta_{min}^{low} > \beta_{P_{a_j}}^{max} \text{ and } \beta_{Q_{a_i}}^{max} < \beta_{min}^{low} \\ \beta_{min}^{low}, \text{ when } \beta_{Q_{a_i}}^{max} > \beta_{min}^{low} > \beta_{P_{a_j}}^{max} \\ \beta_{min}^{low}, \text{ when } \beta_{min}^{low} < \beta_{P_{a_j}}^{max} \end{cases} \quad \text{(formula 1)}$$

where $$\beta_{P_{a_j}}$$

is the first negotiation angle, $a_j$ is the second aircraft, $$\beta_{P_{a_j}}^{max}$$

is the second angle, $\beta_{min}^{low}$ is the third angle, and $$\beta_{Q_{a_i}}^{max}$$

is the first angle;

optionally, determine the second negotiation angle according to the following feasible formula 2:

$$\beta_{P_{a_i}} = \min\{\beta_{min}^{high}, \beta_{P_{a_i}}^{max}\} \quad \text{(formula 2)}$$

where $$\beta_{P_{a_i}}$$

is the second negotiation angle, $a_i$ is the first aircraft, $\beta_{min}^{high}$ is the sixth angle, and $$\beta_{P_{a_i}}^{max}$$

is the fifth angle.

In another possible implementation, the third determining module 54 is specifically configured to:

determine whether the first negotiation angle is less than the first angle;

if yes, determine that the first deflection angle is the first negotiation angle, and the second deflection angle is zero;

if no, determine whether the minimum distance between the first aircraft and the second aircraft within the preset time period is less than the preset distance when the first aircraft is deflected by the first angle, if no, determine that the first deflection angle is the first angle and the second deflection angle is zero, and if yes, determine the first deflection angle and the second deflection angle according to the second negotiation angle and the fourth angle.

In another possible implementation, the third determining module 54 is specifically configured to:

determine whether the second negotiation angle is less than the fourth angle;

if yes, determine that the first deflection angle is the first angle, and the second deflection angle is the second negotiation angle;

if no, determine that the second deflection angle is the fourth angle, and determine the first deflection angle according to the fourth angle and flight information of the first aircraft and the second aircraft.

In another possible implementation, the first determining module 52 is configured to:

optionally, determine the first angle according to the following feasible formula 3:

$$\beta_{Q_{a_i}}^{max} = \pm\left|\beta \times \frac{n_i}{M}\right| \quad \text{(formula 3)}$$

where $$\beta_{Q_{a_i}}^{max}$$

is the first angle, β is the preset limiting deflection angle, M is a total number of aircrafts in an airspace, and $n_i$ is a priority ordinal number of the first aircraft;

optionally, determine the second angle according to the following feasible formula 4:

$$\beta_{P_{a_j}}^{max} = \pm\left|\beta \times \frac{M - n_j}{M}\right| \quad \text{(formula 4)}$$

where $$\beta_{P_{a_j}}^{max}$$

is the second angle, and $n_j$ is a priority ordinal number of the second aircraft;

optionally, determine the fourth angle according to the following feasible formula 5:

$$\beta_{Q_{a_j}}^{max} = \pm\left|\beta \times \frac{n_j}{M}\right| \quad \text{(formula 5)}$$

where $$\beta_{Q_{a_j}}^{max}$$

is the fourth angle;

optionally, determine the fifth angle according to the following feasible formula 6:

$$\beta_{P_{a_i}}^{max} = \pm\left|\beta \times \frac{M - n_i}{M}\right| \quad \text{(formula 6)}$$

where $$\beta_{P_{a_i}}^{max}$$

is the fifth angle.

In another possible implementation, the second determining module 53 is configured to:

optionally, determine the third angle according to the following feasible formula 7:

$$\beta_{min}^{low} = \left[\cos^{-1}\left(\frac{s_{ij}^2 + s_{ii}^2 - (2R_a)^2}{2s_{ij}s_{ii}}\right) - \cos^{-1}\left(\frac{s_{ij}^2 + s_{ii}^2 - (2d_{min})^2}{2s_{ij}s_{ii}}\right)\right]_{min} \quad \text{(formula 7)}$$

where $\beta_{min}^{low}$ is the third angle, $d_{min}$ is a minimum distance between $a_i$ and $a_j$ in a future preset time period, $s_{ij}$ is a distance between a position of $a_i$ at a current moment and a position of $a_j$ when the minimum distance occurs, and $s_{ii}$ is a distance between the position of $a_i$ at the current moment and a position of $a_i$ when the minimum distance occurs, $R_a$ is the preset distance;

optionally, determine the sixth angle according to the following feasible formula 8:

$$\beta_{min}^{high} = \left[\cos^{-1}\left(\frac{s_{ji}^2 + s_{jj}^2 - (2R_a)^2}{2s_{ji}s_{jj}}\right) - \cos^{-1}\left(\frac{s_{ji}^2 + s_{jj}^2 - (2d_{min})^2}{2s_{ji}s_{jj}}\right)\right]_{min} \quad \text{(formula 8)}$$

where $\beta_{min}^{high}$ is the sixth angle, $s_{ji}$, is a distance between a position of $a_j$ at a current moment and the position of $a_j$ when the minimum distance occurs, and $s_{jj}$ is a distance between the position of $a_j$ at the current moment and the position of $a_j$ when the minimum distance occurs.

An embodiment of the present disclosure provides a flight conflict resolution apparatus based on ultimatum game theory, including: a processor coupled to a memory;

the memory is configured to store a computer program;

the processor is configured to execute the computer program stored in the memory, so as to cause a flight conflict resolution apparatus based on ultimatum game theory to perform any one of the methods according to the above method embodiments.

An embodiment of the present disclosure provides a readable storage medium, including a program or an instruction, where when the program or the instruction is running on a computer, any one of the methods according to the above method embodiments is executed.

It will be understood by persons of ordinary skill in the art that all or part of the steps for implementing the above method embodiments may be performed by a program instruction related hardware. The aforementioned program may be stored in a computer readable storage medium. The program, when executed, performs the steps including the above method embodiments; and the foregoing storage medium includes various media that can store a program code, such as a ROM, a RAM, a magnetic disk, or an optical disk.

Finally, it should be noted that the above embodiments are merely illustrative of the technical solutions of the embodiments of the present disclosure, but are not intended to limit thereto. Although the present disclosure has been described in detail with reference to the foregoing embodiments, persons of ordinary skill in the art will understand that the technical solutions described in the foregoing embodiments may be modified, or some or all of the technical features may be equivalently replaced. However, these modifications or replacement do not make the essence of the corresponding technical solution depart from the scope of the technical solutions of the embodiments of the present disclosure.

What is claimed is:

1. A flight conflict resolution method based on ultimatum game theory, comprising:

obtaining a first priority of a first aircraft and a second priority of a second aircraft when it is determined that a minimum distance between the first aircraft and the second aircraft within a preset time period is less than a preset distance;

determining a first angle and a second angle of the first aircraft and a fourth angle and a fifth angle of the second aircraft according to the first priority, the second priority and a preset limiting deflection angle, wherein the first angle is a predetermined maximum allowable deflecting angle of the first aircraft, the second angle is an angle by which the first aircraft is desired to be deflected, the fourth angle is a predetermined maximum allowable deflecting angle of the second aircraft, and the fifth angle is an angle by which the second aircraft is to be deflected;

determining a third angle of the first aircraft and a sixth angle of the second aircraft, wherein the third angle is a deflection angle of the first aircraft causing the minimum distance between the first aircraft and the second aircraft within the preset time period to be greater than or equal to the preset distance when the second aircraft is not deflected, and the sixth angle is a deflection angle of the second aircraft causing the minimum distance between the first aircraft and the second aircraft within the preset time period to be greater than or equal to the preset distance when the first aircraft is not deflected; and determining a first deflection angle of the first aircraft and a second deflection angle of the second aircraft according to the first priority, the second priority, the first angle, the second angle, the third angle, the fourth angle, the fifth angle and the sixth angle, wherein the first aircraft and the second aircraft negotiate according to the first deflection angle of the first aircraft and the second deflection angle of the second aircraft; and the first aircraft and the second aircraft are deflected according to a result of the negotiation, wherein the determining the first deflection angle of the first aircraft and the second deflection angle of the second aircraft according to the first priority, the second priority, the first angle, the second angle, the third angle, the fourth angle, the fifth angle and the sixth angle comprises:

determining a first negotiation angle of the first aircraft among the first angle, the second angle and the third angle according to the first priority and the second priority;

determining a second negotiation angle of the second aircraft among the fourth angle, the fifth angle and the sixth angle according to the first priority and the second priority; and determining the first deflection angle and the second deflection angle according to the first priority, the second priority, the first negotiation angle, the second negotiation angle, the first angle and the fourth angle, wherein the second priority is greater than the first priority, and the determining the first deflection angle and the second deflection angle according to the first priority, the second priority, the first negotiation angle, the second negotiation angle, the first angle and the fourth angle comprises:

determining whether the first negotiation angle is less than the first angle;

if yes, determining that the first deflection angle is the first negotiation angle, and the second deflection angle is zero; and if no, determining whether the minimum distance between the first aircraft and the second aircraft within the preset time period is less than the preset distance when the first aircraft is deflected by the first angle, if no, determining that the first deflection angle is the first angle and the second deflection angle is zero, and if yes, determining the first deflection angle and the second deflection angle according to the second negotiation angle and the fourth angle, wherein the determining the first deflection angle and the second deflection angle according to the second negotiation angle and the fourth angle comprises:

determining whether the second negotiation angle is less than the fourth angle;

if yes, determining that the first deflection angle is the first angle, and the second deflection angle is the second negotiation angle; and if no, determining that the second deflection angle is the fourth angle, and determining the first deflection angle according to the fourth angle and flight information of the first aircraft and the second aircraft.

2. The method according to claim 1, wherein the second priority is greater than the first priority;

the determining the first negotiation angle of the first aircraft among the first angle, the second angle, and the third angle according to the first priority and the second priority comprises:

determining the first negotiation angle according to the following formula 2:

$$\beta_{P_{a_i}} = \min\{\beta_{min}^{high}, \beta_{P_{a_i}}^{max}\} \quad \text{(formula 2)}$$

wherein $$\beta_{P_{a_i}}$$

is the first negotiation angle, $a_i$ is the first aircraft, $\beta_{min}^{high}$ is the third angle, and $$\beta_{P_{a_i}}^{max}$$

is the second angle; and the determining the second negotiation angle of the second aircraft among the fourth angle, the fifth angle and the sixth angle according to the first priority and the second priority comprises:

determining the second negotiation angle according to the following formula 1:

$$\beta_{P_{a_j}} = \begin{cases} \beta_{P_{a_j}}^{max}, \text{ when } \beta_{min}^{low} > \beta_{P_{a_j}}^{max} \text{ and } \beta_{Q_{a_i}}^{max} < \beta_{min}^{low} \\ \beta_{min}^{low}, \text{ when } \beta_{Q_{a_i}}^{max} > \beta_{min}^{low} > \beta_{P_{a_j}}^{max} \\ \beta_{min}^{low}, \text{ when } \beta_{min}^{low} < \beta_{P_{a_j}}^{max} \end{cases} \quad \text{(formula 1)}$$

wherein $$\beta_{P_{a_j}}$$

is the second negotiation angle, $a_j$ is the second aircraft, $$\beta_{P_{a_j}}^{max}$$

is the fifth angle, $\beta_{min}^{low}$ is the sixth angle, and $$\beta_{Q_{a_i}}^{max}$$

is the fourth angle.

3. The method according to claim 1, wherein the determining the first angle and the second angle of the first aircraft and a fourth angle and a fifth angle of the second aircraft according to the first priority, the second priority, and the preset limiting deflection angle comprises:

determining the first angle according to the following formula 3:

$$\beta_{Q_{a_j}}^{max} = \pm\left|\beta \times \frac{n_i}{M}\right| \quad \text{(formula 3)}$$

wherein $$\beta_{Q_{a_i}}^{max}$$

is the first angle, β is the preset limiting deflection angle, M is a total number of aircrafts in an airspace, $n_i$ and is a priority ordinal number of the first aircraft;

determining the second angle according to the following formula 4:

$$\beta_{P_{a_j}}^{max} = \pm\left|\beta \times \frac{M - n_j}{M}\right| \quad \text{(formula 4)}$$

wherein $$\beta_{P_{a_j}}^{max}$$

is the second angle, and $n_j$ is a priority ordinal number of the second aircraft;

determining the fourth angle according to the following formula 5:

$$\beta_{Q_{a_j}}^{max} = \pm\left|\beta \times \frac{n_j}{M}\right| \quad \text{(formula 5)}$$

wherein $$\beta_{Q_{a_j}}^{max}$$

is the fourth angle; and determining the fifth angle according to the following formula 6:

$$\beta_{P_{a_i}}^{max} = \pm\left|\beta \times \frac{M - n_i}{M}\right| \quad \text{(formula 6)}$$

wherein $$\beta_{P_{a_i}}^{max}$$

is the fifth angle.

4. The method according to claim 1, wherein the determining the third angle of the first aircraft and the sixth angle of the second aircraft comprises:

determining the third angle according to the following formula 7:

$$\beta_{min}^{high} = \left[\cos^{-1}\left(\frac{s_{ij}^2 + s_{ii}^2 - (2R_a)^2}{2s_{ij}s_{ii}}\right) - \cos^{-1}\left(\frac{s_{ij}^2 + s_{ii}^2 - (2d_{min})^2}{2s_{ij}s_{ii}}\right)\right]_{min} \quad \text{(formula 7)}$$

wherein $\beta_{min}^{high}$ is the third angle, $d_{min}$ is a minimum distance between $a_i$ and $a_j$ in a future preset time period, $s_{ij}$ is a distance between a position of $a_i$ at a current moment and a position of $a_j$ when the minimum distance occurs, and $s_{ii}$ is a distance between the position of $a_i$ at the current moment and a position of $a_i$ when the minimum distance occurs, $R_a$ is the preset distance; and determining the sixth angle according to the following formula 8:

$$\beta_{min}^{low} = \left[\cos^{-1}\left(\frac{s_{ji}^2 + s_{jj}^2 - (2R_a)^2}{2s_{ji}s_{jj}}\right) - \cos^{-1}\left(\frac{s_{ji}^2 + s_{jj}^2 - (2d_{min})^2}{2s_{ji}s_{jj}}\right)\right]_{min} \quad \text{(formula 8)}$$

wherein $\beta_{min}^{low}$ is the sixth angle, $s_{ji}$ is a distance between a position of $a_j$ at a current moment and the position of $a_i$ when the minimum distance occurs, and $s_{jj}$ is a distance between the position of $a_j$ at the current moment and the position of $a_j$ when the minimum distance occurs.

5. A flight conflict resolution apparatus based on ultimatum game theory, comprising: a processor coupled to a memory;

the memory is configured to store a computer program;

the processor is configured to execute the computer program stored in the memory, so as to cause the flight conflict resolution apparatus based on ultimatum game theory to:

obtain a first priority of a first aircraft and a second priority of a second aircraft when it is determined that a minimum distance between the first aircraft and the second aircraft within a preset time period is less than a preset distance;

determine a first angle and a second angle of the first aircraft and a fourth angle and a fifth angle of the second aircraft according to the first priority, the second priority, and a preset limiting deflection angle, wherein the first angle is a predetermined maximum allowable deflecting angle of the first aircraft, the second angle is an angle by which the first aircraft is desired to be deflected, the fourth angle is a predetermined maximum allowable deflecting angle of the second aircraft, and the fifth angle is an angle by which the second aircraft is to be deflected;

determine a third angle of the first aircraft and a sixth angle of the second aircraft, wherein the third angle is a deflection angle of the first aircraft causing the minimum distance between the first aircraft and the second aircraft within the preset time period to be greater than or equal to the preset distance when the second aircraft is not deflected, and the sixth angle is a deflection angle of the second aircraft causing the minimum distance between the first aircraft and the second aircraft within the preset time period to be greater than or equal to the preset distance when the first aircraft is not deflected; and determine a first deflection angle of the first aircraft and a second deflection angle of the second aircraft according to the first priority, the second priority, the first angle, the second angle, the third angle, the fourth angle, the fifth angle and the sixth angle, wherein the first aircraft and the second aircraft negotiate according to the first deflection angle of the first aircraft and the second deflection angle of the second aircraft; and the first aircraft and the second aircraft are deflected according to a result of the negotiation, wherein the flight conflict resolution apparatus based on ultimatum game theory is specifically configured to:

determine a first negotiation angle of the first aircraft among the first angle, the second angle and the third angle according to the first priority and the second priority;

determine a second negotiation angle of the second aircraft among the fourth angle, the fifth angle and the sixth angle according to the first priority and the second priority; and determine the first deflection angle and the second deflection angle according to the first priority, the second priority, the first negotiation angle, the second negotiation angle, the first angle and the fourth angle, wherein the second priority is greater than the first priority, and the determining the first deflection angle and the second deflection angle according to the first priority, the second priority, the first negotiation angle, the second negotiation angle, the first angle and the fourth angle comprises:

determining whether the first negotiation angle is less than the first angle;

if yes, determining that the first deflection angle is the first negotiation angle, and the second deflection angle is zero; and if no, determining whether the minimum distance between the first aircraft and the second aircraft within the preset time period is less than the preset distance when the first aircraft is deflected by the first angle, if no, determining that the first deflection angle is the first angle and the second deflection angle is zero, and if yes, determining the first deflection angle and the second deflection angle according to the second negotiation angle and the fourth angle, wherein the determining the first deflection angle and the second deflection angle according to the second negotiation angle and the fourth angle comprises:

determining whether the second negotiation angle is less than the fourth angle;

if yes, determining that the first deflection angle is the first angle, and the second deflection angle is the second negotiation angle; and if no, determining that the second deflection angle is the fourth angle, and determining the first deflection angle according to the fourth angle and flight information of the first aircraft and the second aircraft.

6. The apparatus according to claim 5, wherein the second priority is greater than the first priority, and the flight conflict resolution apparatus based on ultimatum game theory is specifically configured to:

determine the first negotiation angle according to the following formula 2:

$$\beta_{P_{a_i}} = \min\{\beta_{min}^{high}, \beta_{P_{a_i}}^{max}\} \quad \text{(formula 2)}$$

wherein $$\beta_{P_{a_i}}$$

is the first negotiation angle, $a_i$ is the first aircraft, $\beta_{min}^{high}$ is the third angle, and $$\beta_{P_{a_i}}^{max}$$

is the second angle; and determine the second negotiation angle according to the following formula 1:

$$\beta_{P_{a_j}} = \begin{cases} \beta_{P_{a_j}}^{max}, \text{ when } \beta_{min}^{low} > \beta_{P_{a_j}}^{max} \text{ and } \beta_{Q_{a_i}}^{max} < \beta_{min}^{low} \\ \beta_{min}^{low}, \text{ when } \beta_{Q_{a_i}}^{max} > \beta_{min}^{low} > \beta_{P_{a_j}}^{max} \\ \beta_{min}^{low}, \text{ when } \beta_{min}^{low} < \beta_{P_{a_j}}^{max} \end{cases} \quad \text{(formula 1)}$$

wherein $$\beta_{P_{a_j}}$$

is the second negotiation angle, $a_j$ is the second aircraft, $$\beta_{P_{a_j}}^{max}$$

is the fifth angle, $\beta_{min}^{low}$ is the sixth angle, and $$\beta_{Q_{a_i}}^{max}$$

is the fourth angle.

7. A flight conflict resolution method based on ultimatum game theory, comprising:

obtaining a first priority of a first aircraft and a second priority of a second aircraft when it is determined that a minimum distance between the first aircraft and the second aircraft within a preset time period is less than a preset distance;

determining a first angle and a second angle of the first aircraft and a fourth angle and a fifth angle of the second aircraft according to the first priority, the second priority and a preset limiting deflection angle, wherein the first angle is a predetermined maximum allowable deflecting angle of the first aircraft, the second angle is an angle by which the first aircraft is desired to be deflected, the fourth angle is a predetermined maximum allowable deflecting angle of the second aircraft, and the fifth angle is an angle by which the second aircraft is to be deflected;

determining a third angle of the first aircraft and a sixth angle of the second aircraft, wherein the third angle is a deflection angle of the first aircraft causing the minimum distance between the first aircraft and the second aircraft within the preset time period to be greater than or equal to the preset distance when the second aircraft is not deflected, and the sixth angle is a deflection angle of the second aircraft causing the minimum distance between the first aircraft and the second aircraft within the preset time period to be greater than or equal to the preset distance when the first aircraft is not deflected; and determining a first deflection angle of the first aircraft and a second deflection angle of the second aircraft according to the first priority, the second priority, the first angle, the second angle, the third angle, the fourth angle, the fifth angle and the sixth angle, wherein the first aircraft and the second aircraft negotiate according to the first deflection angle of the first aircraft and the second deflection angle of the second aircraft; and the first aircraft and the second aircraft are deflected according to a result of the negotiation;

wherein the determining the first angle and the second angle of the first aircraft and a fourth angle and a fifth angle of the second aircraft according to the first priority, the second priority, and the preset limiting deflection angle comprises:

determining the first angle according to the following formula 3:

$$\beta_{Q_{a_i}}^{max} = \pm\left|\beta \times \frac{n_i}{M}\right| \quad \text{(formula 3)}$$

wherein $$\beta_{Q_{a_i}}^{max}$$

is the first angle, $\beta$ is the preset limiting deflection angle, M is a total number of aircrafts in an airspace, and $n_i$ is a priority ordinal number of the first aircraft;

determining the second angle according to the following formula 4:

$$\beta_{P_{a_i}}^{max} = \pm\left|\beta \times \frac{M - n_j}{M}\right| \quad \text{(formula 4)}$$

wherein $$\beta_{P_{a_i}}^{max}$$

is the second angle, and $n_j$ is a priority ordinal number of the second aircraft;

determining the fourth angle according to the following formula 5:

$$\beta_{Q_{a_j}}^{max} = \pm\left|\beta \times \frac{M - n_j}{M}\right| \quad \text{(formula 5)}$$

wherein $$\beta_{Q_{a_j}}^{max}$$

is the fourth angle; and determining the fifth angle according to the following formula 6:

$$\beta_{P_{a_j}}^{max} = \pm\left|\beta \times \frac{M - n_i}{M}\right| \quad \text{(formula 6)}$$

wherein $$\beta_{P_{a_j}}^{max}$$

is the fifth angle.

* * * * *